US010415814B2

(12) United States Patent
Kay et al.

(10) Patent No.: US 10,415,814 B2
(45) Date of Patent: Sep. 17, 2019

(54) ROTATING HANGING LIGHT CONNECTOR

(71) Applicant: PureEdge Lighting LLC, Chicago, IL (US)

(72) Inventors: Gregory L. Kay, Chicago, IL (US); James E. O'Shea, Chicago, IL (US)

(73) Assignee: PureEdge Lighting LLC, Chicago, IL (US)

( * ) Notice: Subject to any disclaimer, the term of this patent is extended or adjusted under 35 U.S.C. 154(b) by 22 days.

(21) Appl. No.: 15/869,240

(22) Filed: Jan. 12, 2018

(65) Prior Publication Data

US 2019/0219256 A1 Jul. 18, 2019

(51) Int. Cl.

| | |
|---|---|
| ***F21S 4/00*** | (2016.01) |
| ***F21V 23/06*** | (2006.01) |
| ***H01R 24/38*** | (2011.01) |
| ***F21S 8/06*** | (2006.01) |
| ***F21V 21/005*** | (2006.01) |
| ***F21K 9/275*** | (2016.01) |
| ***F21K 9/272*** | (2016.01) |

(Continued)

(52) U.S. Cl.

CPC ..... *F21V 23/06* (2013.01); *F21K 9/272* (2016.08); *F21K 9/275* (2016.08); *F21S 8/061* (2013.01); *F21V 21/005* (2013.01); *H01R 24/38* (2013.01); *F21Y 2103/10* (2016.08); *F21Y 2115/10* (2016.08)

(58) Field of Classification Search

CPC ..... F21V 23/00; F21V 23/06; F21V 21/005; F21V 2115/10; F21V 2103/10; F21K 9/272; F21K 9/275; F21S 8/061; H01R 24/38

See application file for complete search history.

(56) References Cited

U.S. PATENT DOCUMENTS 4,310,874 A * 1/1982 Spiteri ..... F21L 14/02 362/212
4,874,320 A * 10/1989 Freed ..... F21S 8/037 439/115

(Continued)

*Primary Examiner* — Ali Alavi
(74) *Attorney, Agent, or Firm* — Bishop, Diehl & Lee Ltd.

(57) ABSTRACT

A lighting system having a light element, a first connector, a second connector and an electrically coupled power source is described. The light element has a light source, a surface for emitting light. The first connector is fixed to an end of the light element and includes a cylindrical housing defining a cylindrical cavity, the cylindrical cavity having a plug positioned therein, the plug being electrically coupled to the light source within the light element, while the second connector couples to the first connector and has an outer housing and a cylindrical cavity defined therein. The first cylindrical housing is configured to frictionally engage an inner wall of the second cylindrical cavity when connected. A second plug positioned within the second cylindrical cavity has a third cylindrical cavity defined therein, wherein the second plug is configured to frictionally engage an inner wall of the cylindrical cavity and the plug is configured to frictionally engage an inner wall within the third cylindrical cavity. The power source is electrically coupled to the plug through connection with the second plug to power the light source. The first connector is capable of being rotated when coupled to the second connector, preferably a full 360 degrees.

19 Claims, 6 Drawing Sheets

(51) Int. Cl.
*F21Y 103/10* (2016.01)
*F21Y 115/10* (2016.01)

(56) References Cited

U.S. PATENT DOCUMENTS 4,999,752 A * 3/1991 Rogers ..... F21L 14/023
315/165
5,471,063 A * 11/1995 Hayes ..... A61L 2/10
210/748.11

* cited by examiner

ROTATING HANGING LIGHT CONNECTOR

TECHNICAL FIELD OF THE INVENTION

The present invention relates to modular lighting systems. Specifically, the disclosed lighting system relates to a lighting connector system used for creating and powering unique lighting structures.

BACKGROUND OF THE INVENTION

Unique lighting systems are beginning to bridge the gap between functional lighting and aesthetic lighting. That is, lighting is no longer necessarily functional or aesthetic, it can be both. The use of LEDs has played a big role in this advancement of the field of lighting. LEDs have significant advantages over incandescent and fluorescent lighting, including having a much lower power requirement, far less heat radiation, higher energy efficiency, longer life expectancy, and greater durability.

These same advantages, as well as others, make the use of LEDs the preferred lighting system for not only appliances, electronics and vehicles, but also for commercial as well as residential buildings. Lighting structures are not limited to merely highlighting aesthetic features in these buildings; they are quickly becoming a focal point in almost every room.

Accordingly, versatility of lighting structures is a common goal of designers. For example, existing hanging light structures tend to have limited versatility due, in part, to having a fixed lighting direction. That is, once installed, the lighting direction of hanging lights is not easily changed. However, the ability to alter the lighting direction of these lights is of great value to an end user, for obvious reasons. Additionally, installation of the hanging lights can be made simpler with such directional versatility.

Until the invention of the present application, these and other problems in the prior art went either unnoticed or unsolved by those skilled in the art. The present inventions provide a versatile hanging light structure and lighting system connectors which perform multiple functions with a light source without sacrificing design, functionality, style or affordability.

SUMMARY OF THE INVENTION

There is disclosed herein an improved lighting system which avoids the disadvantages of prior devices while affording additional structural and operating advantages.

Generally speaking, the lighting system comprises a light element, a first connector, a second connector and an electrically coupled power source.

In a specific preferred embodiment, the light element has a light source, a surface for emitting light from the light source and an end. The first connector is fixed to the end of the light element and comprises a first cylindrical housing defining a first cylindrical cavity therein, the first cylindrical cavity having a first plug positioned therein, the first plug being electrically coupled to the light source within the light element, while the second connector couples to the first connector and has an outer housing and a second cylindrical cavity defined therein, wherein the first cylindrical housing is configured to frictionally engage an inner wall of the second cylindrical cavity when connected. A second plug positioned within the second cylindrical cavity has a third cylindrical cavity defined therein, wherein the second plug is configured to frictionally engage an inner wall of the first cylindrical cavity and the first plug is configured to frictionally engage an inner wall within the third cylindrical cavity. Finally, the power source is electrically coupled to the first plug through connection with the second plug to thereby power the light source. The first connector is capable of being rotated when coupled to the second connector, preferably the first connector is capable of 360 degree rotation when coupled to the second connector.

In another specific embodiment, the power source is either AC or DC power, the former provided through electrical wiring electrically coupled to the second plug and the wiring is used for hanging or suspending the lighting system.

In a specific preferred embodiment, the first and second plugs comprise cylindrical friction plugs of different sizes.

In still a further specific embodiment, the second connector is a double connector and comprises a fourth cylindrical cavity defined within the outer housing. Accordingly, the lighting system might then comprise a second light element having a light source, a surface for emitting light from the light source and an end, and a third connector fixed to the end of the second light element, the third connector comprising a third cylindrical housing defining a fifth cylindrical cavity therein, the fifth cylindrical cavity having a third plug positioned therein, the third plug being electrically coupled to the light source within the second light element, wherein the third cylindrical housing is configured to frictionally engage an inner wall of the fourth cylindrical cavity when connected, and the third connector is capable of being rotated 360 degrees when coupled to the second connector.

In a specific embodiment, the preferred light source comprises an LED strip within a light tube.

A connection system for a lighting structure is also set forth. The connection system comprises a first connector comprising a first cylindrical housing defining a first cylindrical cavity therein, the first cylindrical cavity having a first plug positioned therein, the first plug being configured for electric connection to a light source of the lighting structure, a second connector for coupling to the first connector and having an outer housing and a second cylindrical cavity defined therein, wherein the first cylindrical housing is configured to frictionally engage an inner wall of the second cylindrical cavity when connected, a second plug positioned within the second cylindrical cavity and having a third cylindrical cavity defined therein, wherein the second plug is configured to frictionally engage an inner wall of the first cylindrical cavity and the first plug is configured to frictionally engage an inner wall within the third cylindrical cavity, and wiring electrically coupled to the first plug through connection with the second plug to thereby conduct power to the light source of the lighting structure. The first connector is capable of being rotated 360 degrees when coupled to the second connector.

These and other aspects of the invention may be understood more readily from the following description and the appended drawings.

BRIEF DESCRIPTION OF THE DRAWINGS

For the purpose of facilitating an understanding of the subject matter sought to be protected, there are illustrated in the accompanying drawings, embodiments thereof, from an inspection of which, when considered in connection with the following description, the subject matter sought to be protected, its construction and operation, and many of its advantages should be readily understood and appreciated.

DETAILED DESCRIPTION OF THE INVENTION

Figure 1:
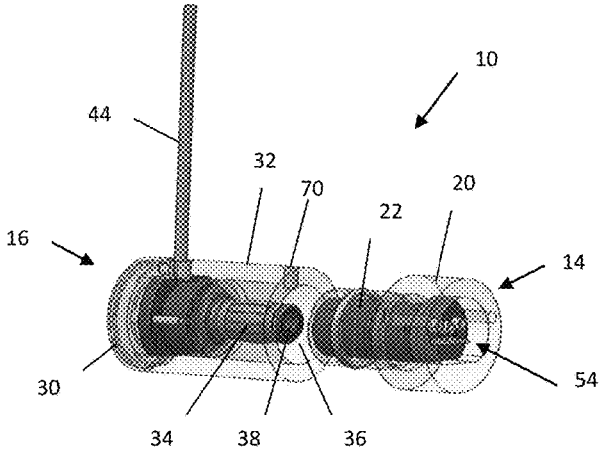
FIG. 1 is a perspective transparent view of an embodiment of a first and second connector in accordance with the present description.

While this invention is susceptible of embodiments in many different forms, there is shown in the drawings and will herein be described in detail at least one preferred embodiment of the invention with the understanding that the present disclosure is to be considered as an exemplification of the principles of the invention and is not intended to limit the broad aspect of the invention to any of the specific embodiments illustrated.

Referring to FIGS. 1-13, there is illustrated a hanging light system, generally designated by the numeral 10. The particular illustrated lighting system 10 is for tube lights. In fact, while all the embodiments illustrated are directed to LED tube lights, it should be understood that the principles of the invention may be more broadly applied to use with other light sources, as well.

Figure 2:
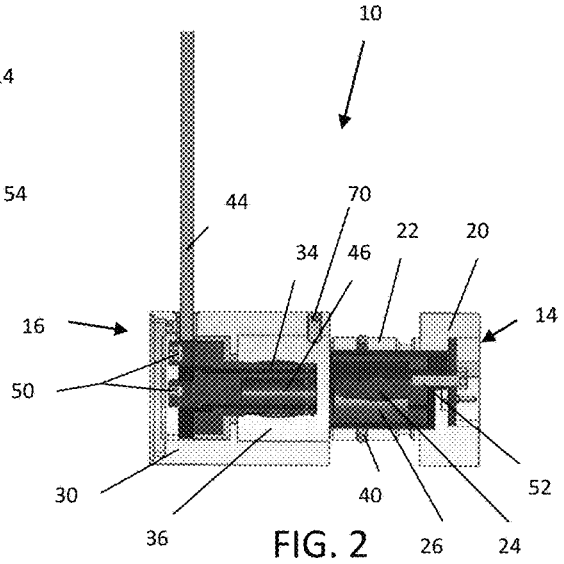
FIG. 2 is a side cross sectional view of the first and second connectors of FIG. 1.
Figure 3:
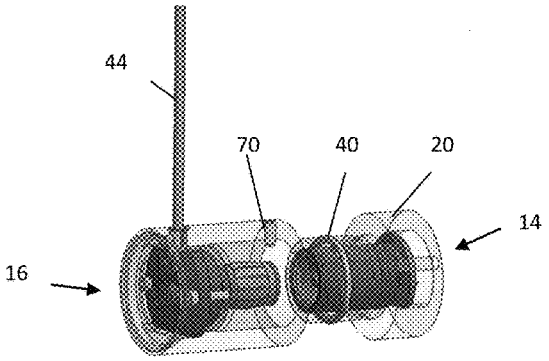
FIG. 3 is another perspective transparent view of the first and second connectors of FIG. 1.

As can be seen in FIGS. 1-3, a key component of the lighting system 10 is the connection system 12 used to couple a light source to a power source. This connection system is comprised of a first connector 14 and a complementary second connector 16. The first connector 14 includes a base 20 and a cylindrical housing 22 with a first plug 24, preferably a cylindrical friction plug (e.g., commonly known as a "banana plug" in the industry), positioned within a first cylindrical cavity 26 defined within the housing 22. Likewise, the second connector 16 includes a base 30 and a cylindrical housing 32 with a second plug 34, preferably a larger cylindrical friction plug (e.g., a banana plug), positioned within a second cylindrical cavity 36 of the housing 32. The second plug 34 includes an opening 38 and a third cylindrical cavity 46. When connected, as shown, the first plug 24 inserts into the third cylindrical cavity 46, and the second plug 34 inserts into the first cylindrical cavity 26.

Preferably, the plugs friction fit within the cavities to form a secure connection. However, the cylindrical housing 22 may include a friction member 40, such as an O-ring, to further facilitate a secure connection. A set screw 70 (FIGS. 1-3) may also be used to secure the first connector 14 to the second connector 16 and prevent rotation and disconnection. Other useful connection features known to those skilled in the art may also be useful for specific applications.

Figure 4:
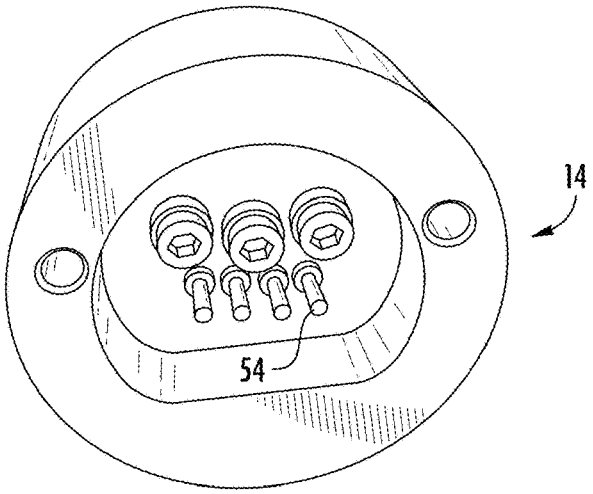
FIG. 4 is a top plan view of a backside of an embodiment of a first connector.
Figure 5:
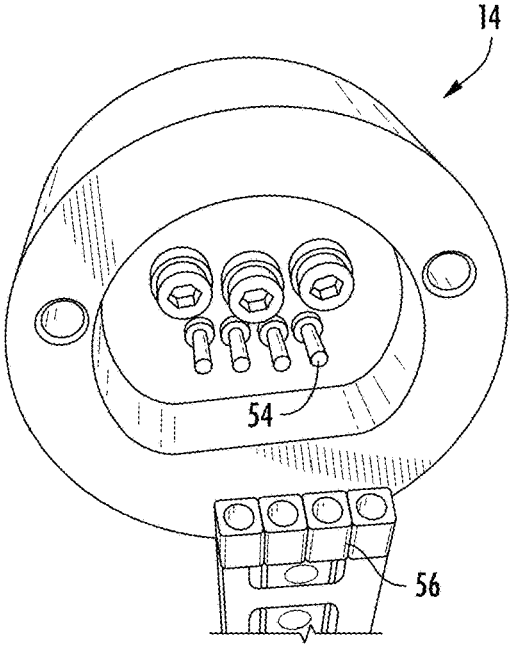
FIG. 5 is another top plan view of the first connector of FIG. 4 and includes an LED strip connector.
Figure 6:
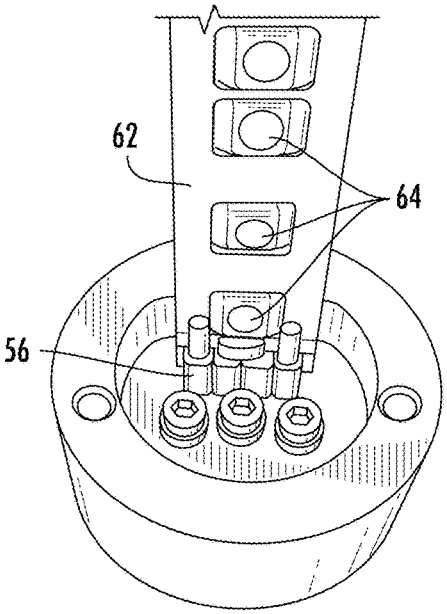
FIG. 6 is perspective view showing the LED strip connector connected to the terminals of the first connector.

Within the base 30 of the second connector 16, electric wiring 44 connects to terminals 50 which then feed power to the second plug 34. Similarly, the base 20 of the first connector 14 includes an electrical connector 52 coupled to the first plug 24 and an inner wall of the first cylindrical cavity 26 back to a tube light connector 54. As is known by those skilled in the art, an LED strip connector 56 is readily plugged into the tube light connector 54, as shown in FIGS. 4-6. Accordingly, when the electrical wiring 44 is plugged into a power source (e.g., 120V AC), power is conducted into the second connector 16, via terminals 50, to the second plug 34, then into the first plug 24 and inner wall of the first cylindrical cavity 26 by way of contact with the second plug 34, then to the electrical connector 52, the tube light connector 54 and finally to the LED strip 62 via the strip connector 56. The electric wiring 44 (see also FIG. 8) can be used to suspend the light structure from a ceiling or the like.

Figure 7:
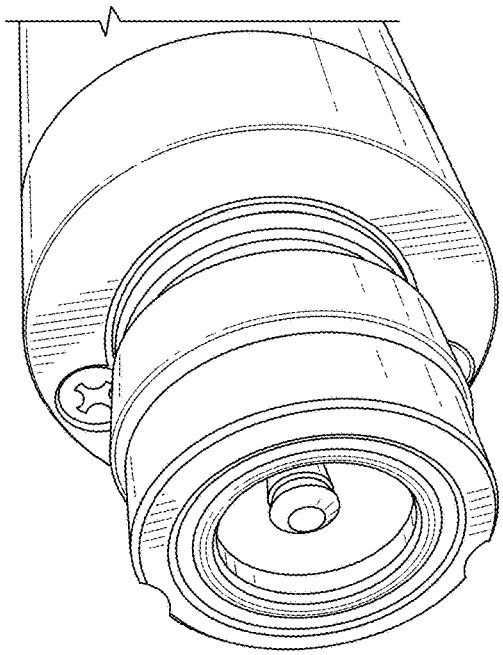
FIG. 7 is a perspective view of an embodiment of the first connector attached to a light tube.
Figure 8:
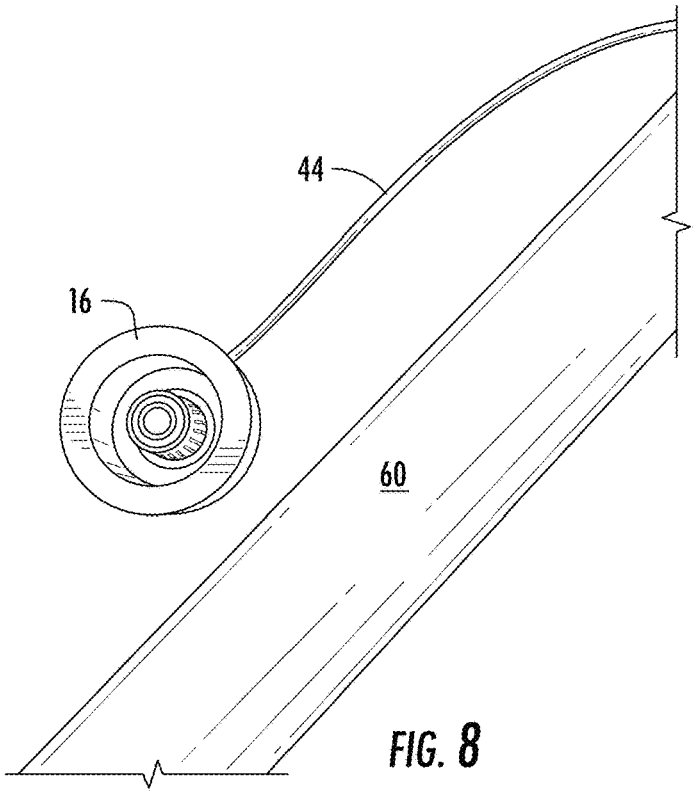
FIG. 8 is top view showing an embodiment of a second connector alongside a light tube.
Figure 9:
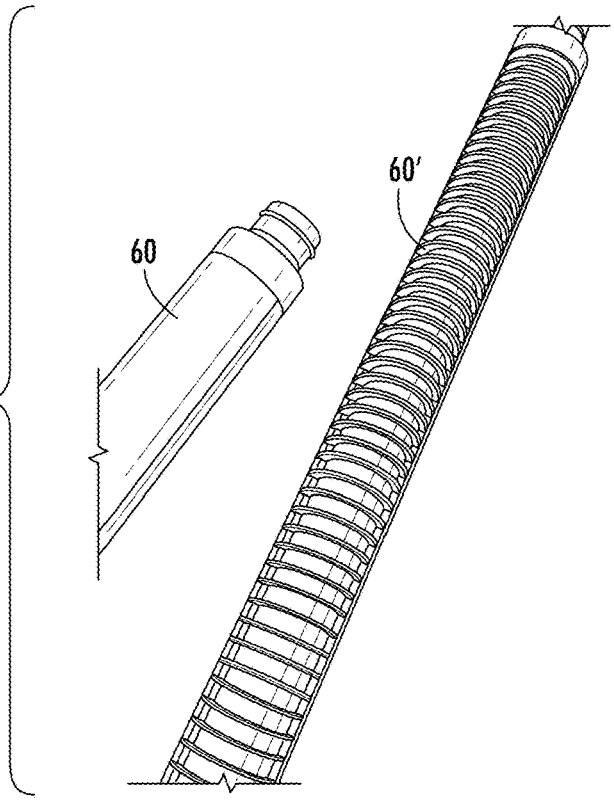
FIG. 9 is top view showing two different light tubes with first connectors.
Figure 10:
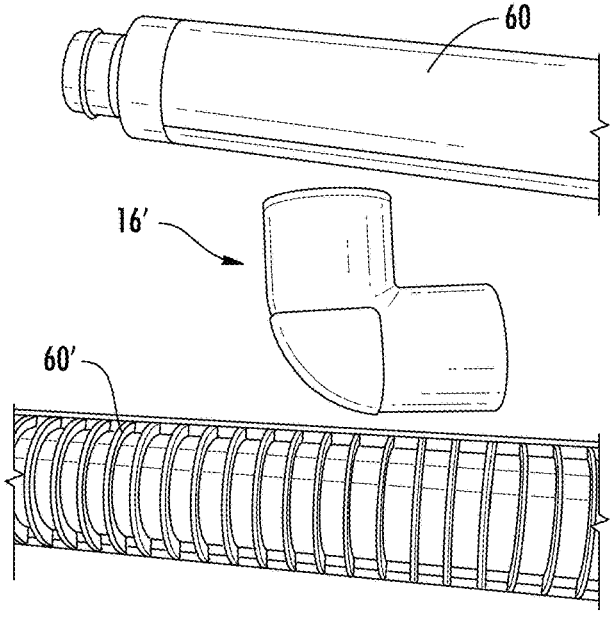
FIG. 10 is top view showing a first connector attached to a light tube and an embodiment of a double connector.

As shown in FIGS. 7, 9 and 10, the first connector 14 is attached to at least one end of an LED light tube 60. Typically, the light tube 60 has a connector 14 on both ends, as will be explained further below. The tube 60, as is generally known by those skilled in the art, contains an LED strip 62 (FIG. 6) having a plurality of LEDs 64 thereon, as well as a backlight surface 66 and a light emitting surface 68, through which light is directed.

It is the unique configuration of the two connectors, 14 and 16, which provides significant versatility to the present system 10. As shown in the numerous figures, the various cavities and plugs on the connectors 14, 16 are all cylindrical in shape. This, of course, allows them to rotate within one another—a full 360 degrees in the present embodiment. The permitted rotation allows light from the light tube 60 to be directed in a full 360 degrees as well. A locking mechanism, e.g., set screw 70 (see FIGS. 1-3), allows the light tube 60 to be locked in place, when desired. Where multiple tubes are connected together (as described below), each can be directed differently, if desired. This also helps with design and installation of light structures using the present connection system 12, as the lighting direction can be altered after install.

Figure 11:
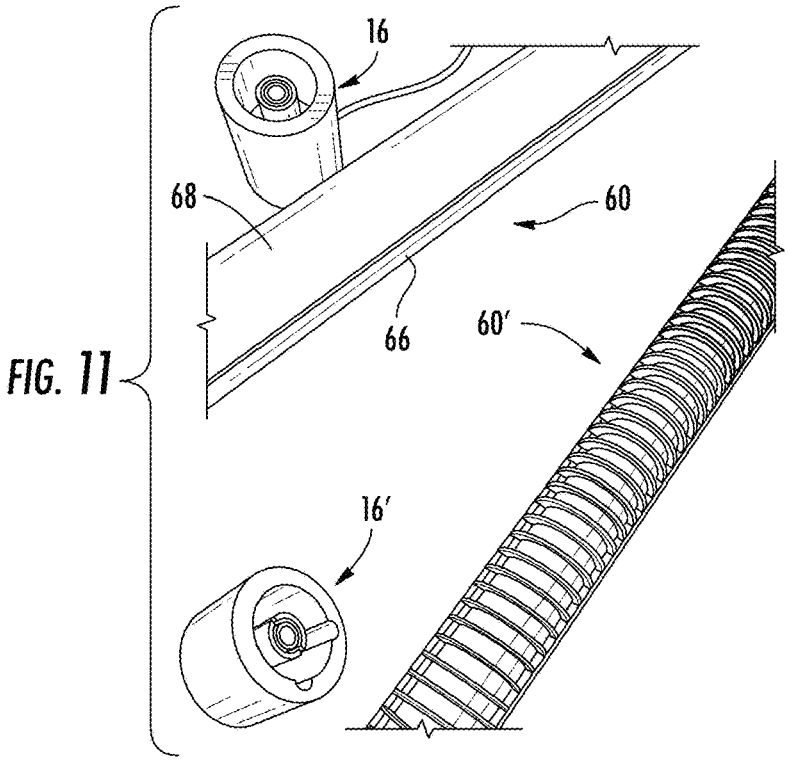
FIG. 11 is a top view of the second connector of FIG. 8 and a double connector of FIG. 10 with two light tubes.
Figure 12:
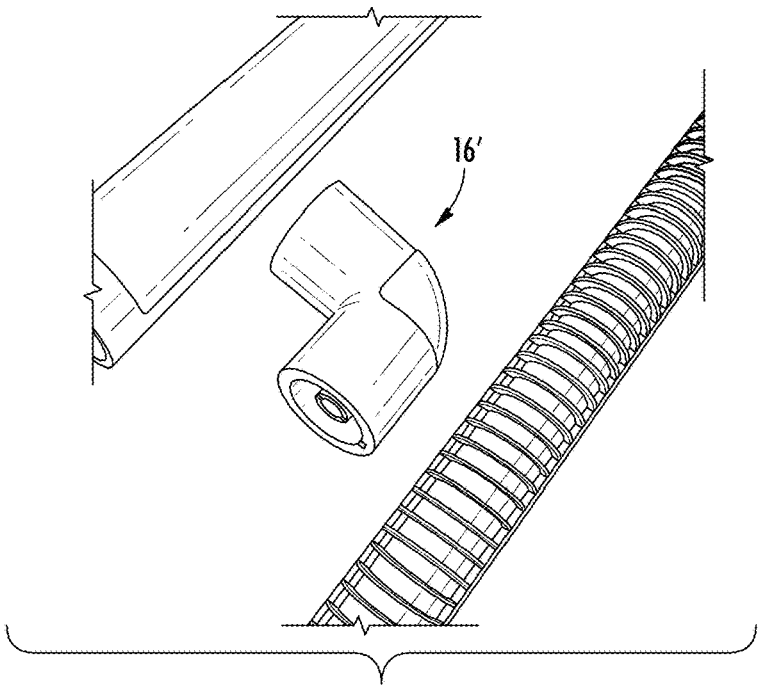
FIG. 12 is a top view of the double connector of FIG. 8 and two light tubes.
Figure 13:
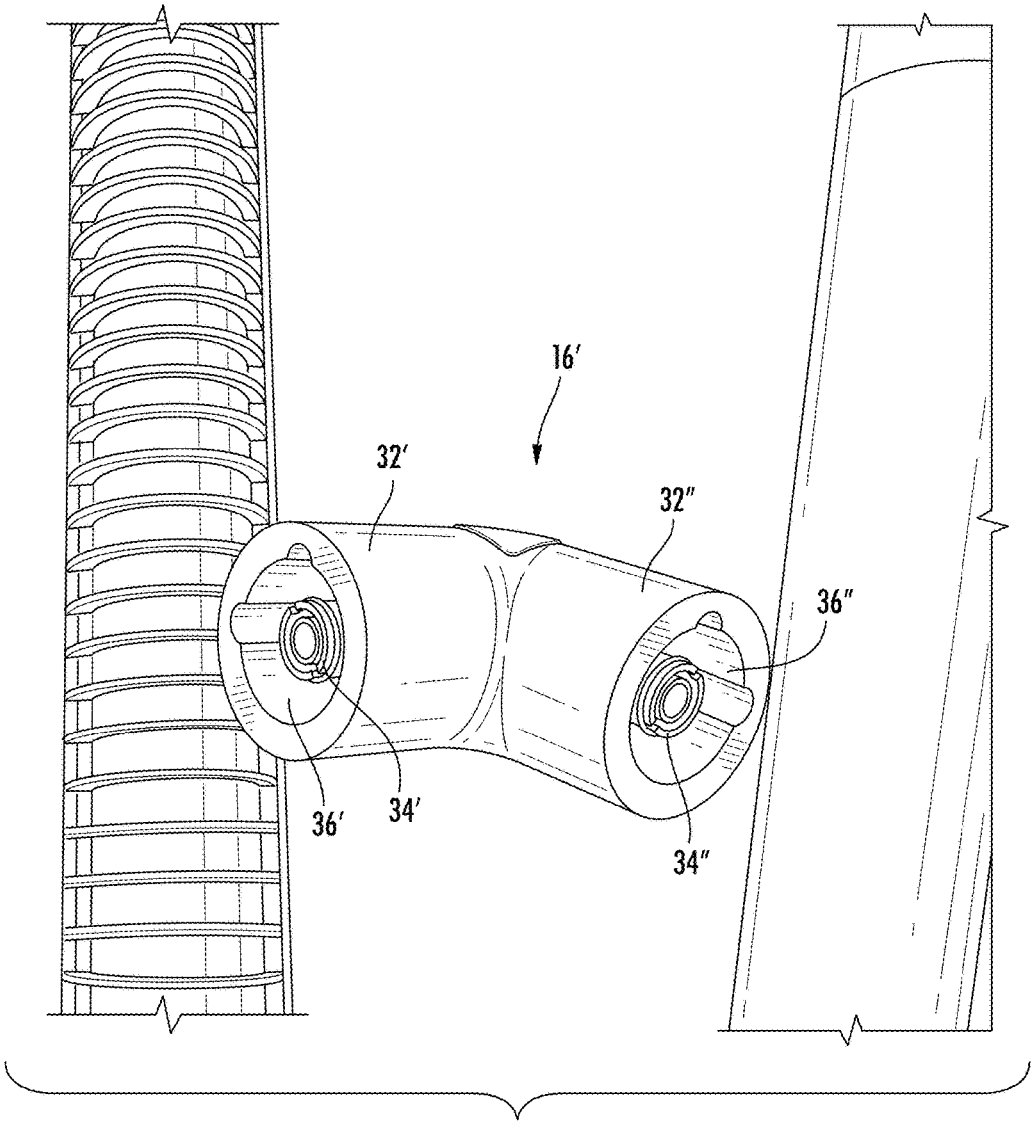
FIG. 13 is still another top view showing the connecting end of the double connector of FIG. 8.

As noted above, typical light tubes 60 will have connector 14 on both ends. FIGS. 11-13 illustrate a double connector 16' to join two light tubes 60, 60' together. The connector 16' is a 90° elbow connector, but straight double connectors, acute and obtuse angled double connectors, and even flexible double connectors are possible. As shown, the double connector 16' has identical cylindrical cavities 36', 36" and identical plugs 34', 34" within the cavities 36', 36" on both ends, respectively. This allows a light tube connected on one end to be directed differently than a light tube connected to the other end, if desired.

In an alternate configuration, the lighting system 10 does not hang from wiring attached to the second connector 16. Rather, a second connector 16 is fixed to a wall, ceiling or other surface (not shown) and directly wired to a power source, as is known in the art. A first connector 14 could then be connected to the fixed second connector 16 as previously described. The lighting direction could easily be rotated as desired, and then fixed with the locking mechanism (e.g., set screw 70), as detailed above.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A lighting system comprising:

a light element having a light source, a surface for emitting light from the light source and an end;

a first connector fixed to the end of the light element, the first connector comprising a first cylindrical housing defining a first cylindrical cavity therein, the first cylindrical cavity having a first plug positioned therein, the first plug being electrically coupled to the light source within the light element;

a second connector for coupling to the first connector and having an outer housing and a second cylindrical cavity defined therein, wherein the first cylindrical housing is configured to frictionally engage an inner wall of the second cylindrical cavity when connected;

a second plug positioned within the second cylindrical cavity and having a third cylindrical cavity defined therein, wherein the second plug is configured to frictionally engage an inner wall of the first cylindrical cavity and the first plug is configured to frictionally engage an inner wall within the third cylindrical cavity; and a power source electrically coupled to the first plug through connection with the second plug to thereby power the light source;

wherein the first connector is capable of being rotated when coupled to the second connector.

2. The lighting system of claim 1, wherein the first connector is capable of 360 degree rotation when coupled to the second connector.

3. The lighting system of claim 1, further comprising a friction member positioned on an outer surface of the first cylindrical housing for engaging the inner wall of the second cylindrical cavity.

4. The lighting system of claim 3, wherein the friction member is an O-ring.

5. The lighting system of claim 1, wherein the power source provides power through wiring electrically coupled to the second plug.

6. The lighting system of claim 1, further comprising at least one cable for hanging the lighting system.

7. The lighting system of claim 6, wherein the at least one cable comprises electrical wiring connected to the second connector.

8. The lighting system of claim 1, wherein the first plug comprises a cylindrical friction plug.

9. The lighting system of claim 1, wherein the second plug comprises a cylindrical friction plug.

10. The lighting system of claim 1, wherein the second connector comprises a fourth cylindrical cavity defined within the outer housing.

11. The lighting system of claim 10, further comprising:

a second light element having a light source, a surface for emitting light from the light source and an end; and a third connector fixed to the end of the second light element, the third connector comprising a third cylindrical housing defining a fifth cylindrical cavity therein, the fifth cylindrical cavity having a third plug positioned therein, the third plug being electrically coupled to the light source within the second light element;

wherein the third cylindrical housing is configured to frictionally engage an inner wall of the fourth cylindrical cavity when connected, and the third connector is capable of being rotated 360 degrees when coupled to the second connector.

12. The lighting system of claim 1, wherein the light source comprises an LED strip.

13. A connector system for a lighting structure, the connector system comprising:

a first connector comprising a first cylindrical housing defining a first cylindrical cavity therein, the first cylindrical cavity having a first plug positioned therein, the first plug being configured for electric connection to a light source of the lighting structure;

a second connector for coupling to the first connector and having an outer housing and a second cylindrical cavity defined therein, wherein the first cylindrical housing is configured to frictionally engage an inner wall of the second cylindrical cavity when connected;

a second plug positioned within the second cylindrical cavity and having a third cylindrical cavity defined therein, wherein the second plug is configured to frictionally engage an inner wall of the first cylindrical cavity and the first plug is configured to frictionally engage an inner wall within the third cylindrical cavity; and wiring electrically coupled to the first plug through connection with the second plug to thereby conduct power to the light source of the lighting structure;

wherein the first connector is capable of being rotated 360 degrees when coupled to the second connector.

14. The connector system of claim 13, further comprising at least one cable for hanging a lighting structure connected to the connector system.

15. The connector system of claim 14, wherein the at least one cable comprises the wiring connected to the second plug in the second connector.

16. The connector system of claim 13, wherein the first plug comprises a cylindrical friction plug.

17. The connector system of claim 13, wherein the second plug comprises a cylindrical friction plug.

18. The connector system of claim 13, wherein the second connector comprises a fourth cylindrical cavity defined within the outer housing.

19. The connector system of claim 18, further comprising:

a third connector comprising a third cylindrical housing defining a fifth cylindrical cavity therein, the fifth cylindrical cavity having a third plug positioned therein, the third plug being configured for electrical connection to a light source of the lighting structure;

wherein the third cylindrical housing is configured to frictionally engage an inner wall of the fourth cylindrical cavity when connected, and the third connector is capable of being rotated 360 degrees when coupled to the second connector.

* * * * *